US005689950A

United States Patent [19]

Smith

[11] Patent Number: 5,689,950

[45] Date of Patent: Nov. 25, 1997

[54] ION THRUSTER WITH GRAPHITE ACCELERATOR GRID

[75] Inventor: Peter Smith, Hamshire, United Kingdom

[73] Assignee: Matra Marconi Space UK Limited, United Kingdom

[21] Appl. No.: 604,337

[22] Filed: Feb. 21, 1996

[30] Foreign Application Priority Data

Mar. 20, 1995 [GB] United Kingdom ..... 9505610

[51] Int. Cl.[6] ..... F03H 1/00

[52] U.S. Cl. ..... 60/202; 313/360.1

[58] Field of Search ..... 60/202, 203.1; 313/299, 359.1, 360.1, 361.1, 362.1, 363.1

[56] References Cited

U.S. PATENT DOCUMENTS

| | | | |
|---|---|---|---|
| 4,263,528 | 4/1981 | Miram . | |
| 4,302,701 | 11/1981 | Beling | 313/293 |
| 4,447,773 | 5/1984 | Aston | 328/233 |
| 4,825,646 | 5/1989 | Challoner et al. . | |
| 5,216,330 | 6/1993 | Ahonen | 313/111.51 |

FOREIGN PATENT DOCUMENTS

| | | |
|---|---|---|
| 0 028 922 A2 | 5/1981 | European Pat. Off. . |
| 0 330 543 A1 | 8/1989 | European Pat. Off. . |
| 1 206 049 | 9/1970 | United Kingdom . |
| 1 504 784 | 3/1978 | United Kingdom . |

*Primary Examiner*—Louis J. Casaregola
*Attorney, Agent, or Firm*—Kirschstein, et al.

[57] ABSTRACT

An ion thruster comprises a chamber in which propellant is ionized and an accelerator grid, whereby a flow of ions out of the chamber provides reactive thrust. Charge exchange between neutral atoms of propellant and fast moving ions produces slow ions which impact on the accelerator grid and erode it by sputtering, thus limiting the lifetime of the thruster. The invention includes an accelerator grid comprising a layer which includes graphite providing resistance to erosion and a support layer which overcomes the restrictions on engineering and strength of graphite. The accelerator grid can be constructed by machining a block of graphite 12 to produce an upper surface 13, to which the molybdenum grid 14 can be fixed. The block 12 can then be cut away to permit the graphite to be machined to the same contour as the surface 13. Apertures are drilled through the graphite using the existing apertures of the grid 14 as guides.

10 Claims, 3 Drawing Sheets

ION THRUSTER WITH GRAPHITE ACCELERATOR GRID

BACKGROUND OF THE INVENTION

This invention relates to ion thrusters.

Such thrusters comprise a chamber in which propellant is ionised at a high positive voltage, and a negatively charged accelerator grid to allow a flow of ions out of the chamber to provide a reactive thrust. The accelerator grid also prevents electron backstreaming i.e. electrons are emitted outside the thruster in order to neutralise the emergent ionic beam, and would be drawn back into the highly positive chamber thus producing a backstream of electrons if it were not for the presence of the negatively charged accelerator grid. Such thrusters can provide a relatively high specific impulse (the quantity which gives a measure of the impulse which can be produced from a given mass of propellant) since electrical power is used to transfer energy into the propellant.

Ion thrusters have been proposed for use on spacecraft for adjusting the position, attitude and/or orbit of the spacecraft.

One of the problems which would be encountered with such ion thrusters is the erosion of the accelerator grid by impact of slow moving ions, which can wear the accelerator grid away to such an extent as to form the limiting factor on the life of the thruster.

Slow moving ions are produced because a certain percentage of the propellant in the chamber remains as neutral atoms which however undergo charge exchange in the vicinity of the accelerator grid. This means that a fast moving ion passes sufficiently close to a neutral atom that charge exchange occurs, producing a fast moving neutral atom in the exhaust stream but a slow moving ion in the vicinity of the accelerator grid. The latter is attracted to the accelerator grid, and the resulting impact ejects one or more atoms from the accelerator grid, thereby eroding the grid in a process known as sputtering.

Various proposals have been made to eliminate or alleviate this problem. Thus, for example, it has been proposed to reduce the voltage on the accelerator grid. The use of a decelerator grid, also at a negative potential like the accelerator grid but less so, has been proposed, to be positioned downstream of the accelerator grid with the intention that slow moving ions created downstream of the accelerator grid will be attracted back to the decelerator grid and will not impact on the accelerator grid. This has to some extent increased the life of the accelerator grid. Another proposal has been to make the accelerator grid out of a material with a low sputter yield, such as graphite. However, difficulties in engineering the graphite mean that the graphite grid is relatively thick compared with a metallic grid, and as a result the thruster performance is reduced. It has also been proposed to make the accelerator grid out of carbon fibre, but the problem here is that fibres could become detached from the grid and provide a short circuit between different grids.

SUMMARY OF THE INVENTION

The invention provides an ion thruster comprising a chamber in which propellant is ionised, and an accelerator grid whereby a reactive thrust is provided by a flow of ions out of the chamber, wherein the grid comprises a layer which includes graphite and a layer for supporting the layer which includes graphite.

The provision of a layer specifically to provide support for the layer which includes graphite enables the grid to benefit from the resistance to erosion of graphite without encountering the restrictions on engineering and strength hitherto associated with the use of graphite.

The support layer may be molybdenum, and it may be found desirable to provide a pair of molybdenum layers with the layer containing graphite sandwiched between. The layer which includes graphite may be a material such as a compound material which is loaded with graphite, or it may be wholly graphite.

BRIEF DESCRIPTION OF THE DRAWINGS

An ion thruster constructed in accordance with the invention will now be described, by way of example, with reference to the accompanying drawings, in which.

DETAILED DESCRIPTION OF THE PREFERRED EMBODIMENTS

Figure 1:
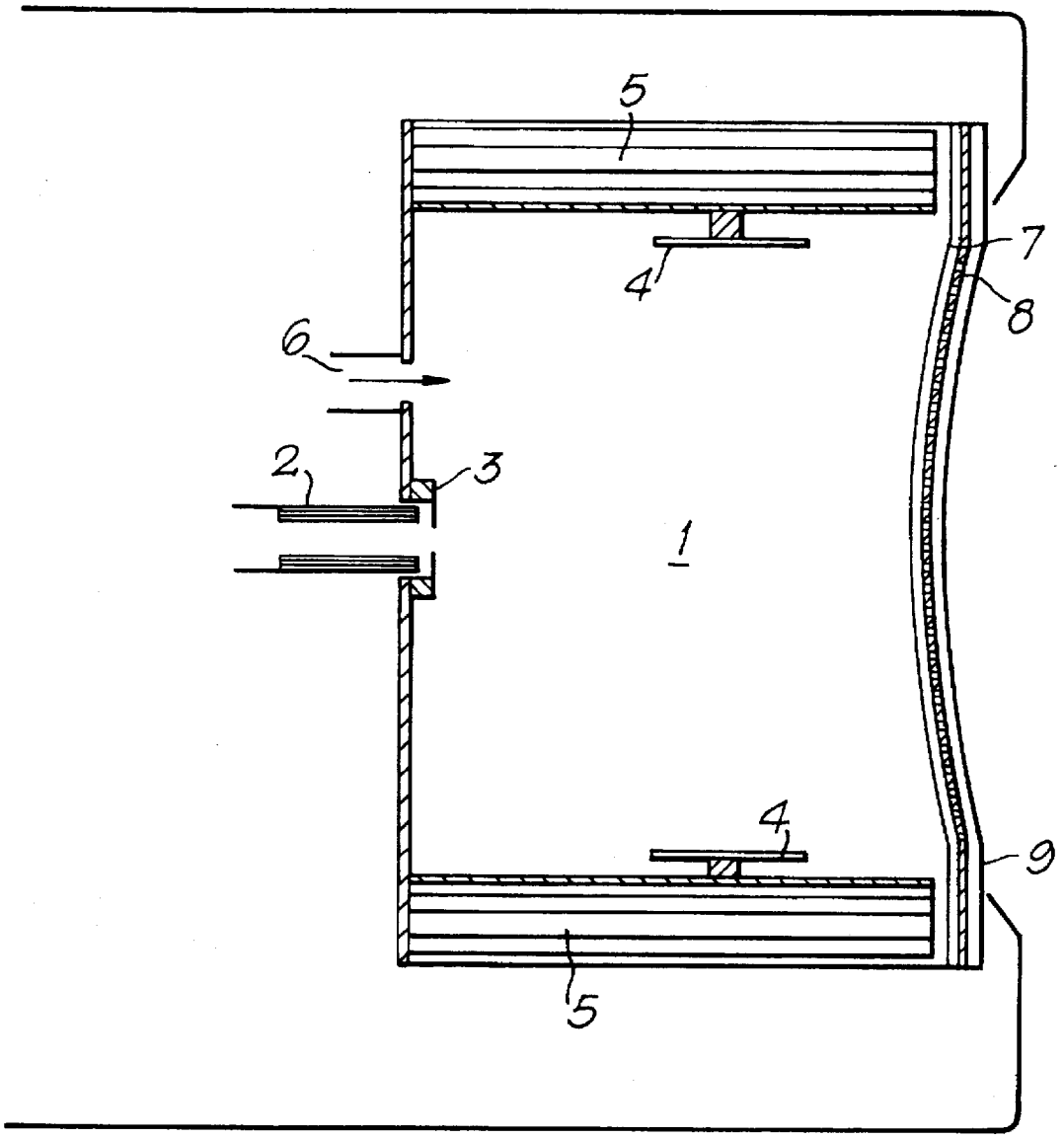
FIG. 1 is a section through the ion thruster.

Referring to FIG. 1, the ion thruster comprises a discharge chamber 1, a hollow cathode 2, a cathode keeper 3, an annular anode 4 and solenoid coils 5. Propellant is fed into the hollow cathode 2 and is ionised by an arc which is struck between the cathode and the cathode keeper 3 which is more positive than the cathode. The electrons produced in the arc are attracted towards the anode 4. The solenoid coils 5 generate a magnetic field which is experienced by the electrons as they move from the cathode 2 to the anode 4. The magnetic field causes the electrons to move in spiral paths in the discharge chamber 1. Propellant is fed directly into the discharge chamber via the inlet 6 and is ionised by collision with the spiralling electrons. As the electron path is increased by the cyclotron effect of the magnetic field, the probability of collision with an atom of propellant is increased and thus there is an enhancement of ionisation efficiency.

Figure 2:
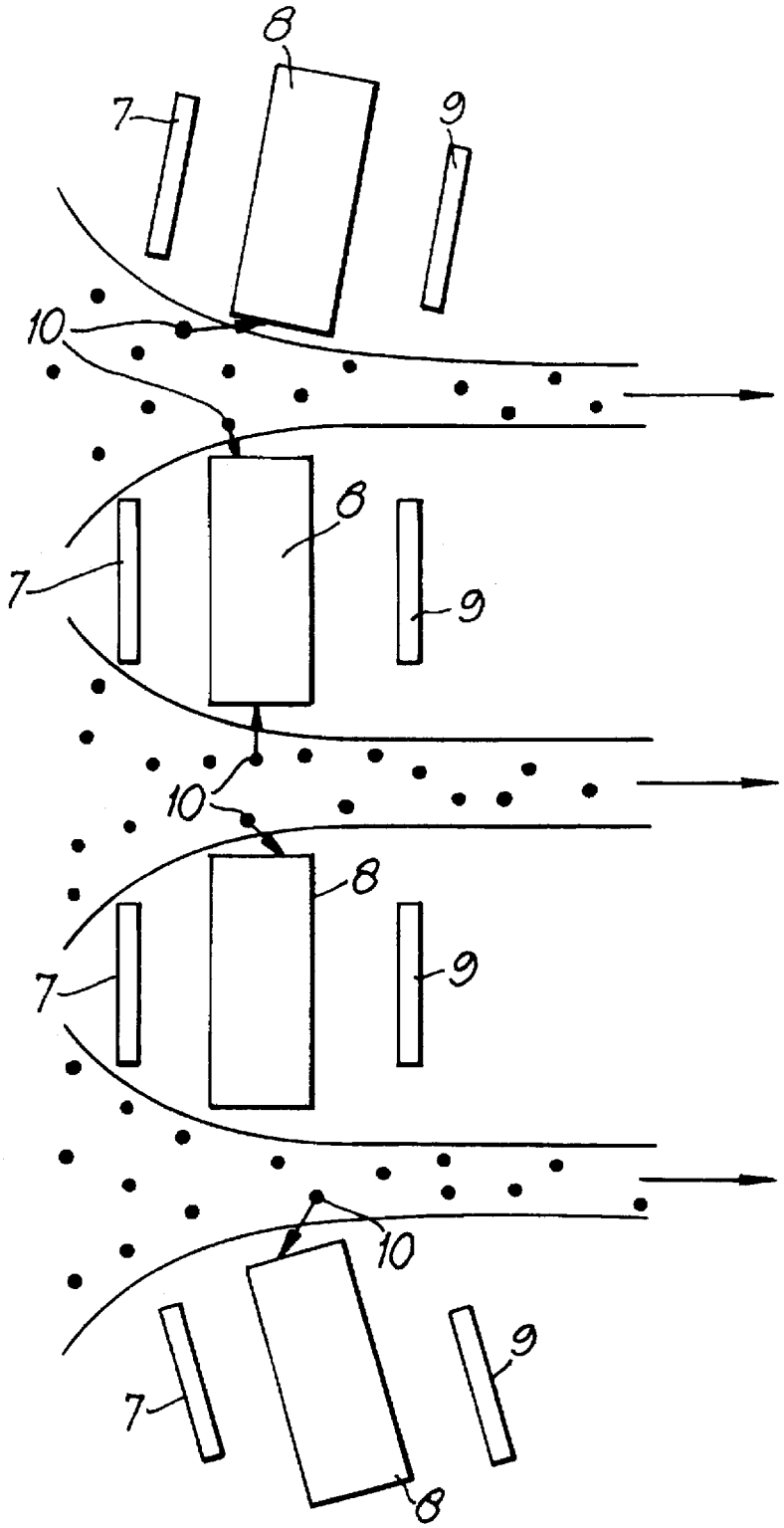
FIG. 2 is a section through the grids of the ion thruster of FIG. 1 on an enlarged scale.

There is also provided a screen grid 7, an accelerator grid 8 and a decelerator grid 9: these grids are shown on an enlarged scale in FIG. 2. The screen grid 7 is maintained at the same positive potential as the discharge chamber and serves to screen the ions which drift towards it from the accelerator grid 8, which is at a negative potential. Those ions in close vicinity to the screen grid 7 are attracted towards and through the negatively charged accelerator grid 8. These ions generate a high velocity exhaust stream which imparts the reactive thrust to the ion thruster.

However, the discharge chamber 1 is not 100% efficient in ionising the propellant, and a certain percentage remains as neutral atoms. Some of these undergo charge exchange, resulting in an energetic neutral atom in the exhaust stream and a slow moving charged ion in the vicinity of the grids. These slow moving ions 10 will not have sufficient energy to escape the chamber 1 into the exhaust stream and will be attracted to the accelerator grid 8. The decelerator grid 9 is maintained at a potential which is less negative than that of the accelerator grid 8 to ensure that secondary ions generated downstream of the accelerator grid are not attracted back to the accelerator grid.

Typically, the discharge chamber 1 is maintained at a positive potential of around 1,100 volts, the accelerator grid at a negative potential of around 250 volts and the decelerator grid may be at 0 volts or at a negative potential of around 50 volts.

The slow moving ions 10 attracted to the accelerator grid cause a serious problem in the case of a typical prior art accelerator grid made of molybdenum. The ions eject atoms from the grid and thereby erode it, even to an extent to cause the main limitation in the life of the thruster.

The manufacture of an accelerator grid which considerably alleviates the problem of erosion will now be described by reference to FIGS. 3 to 5.

Figure 3:
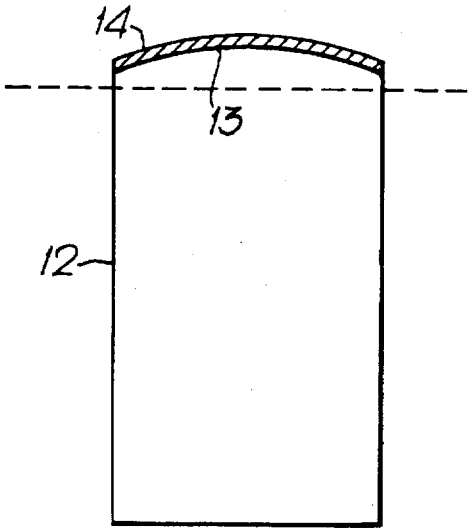
FIG. 3 is a sectional view of a block of graphite with a grid of molybdenum fixed onto its upper surface.

FIG. 3 shows a section through a cylindrical block of graphite 12. Graphite blocks are able to be machined precisely and the top surface 13 of the block 12 is machined to produce the surface curvature desired for the accelerator grid. A grid 14 of molybdenum is then fixed by adhesive to the top surface of the graphite block.

Figure 4:
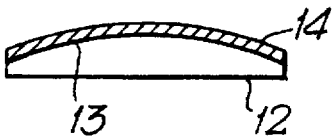
FIG. 4 is a sectional view of the block and grid of FIG. 3 with the lower part of the block removed.
Figure 5:
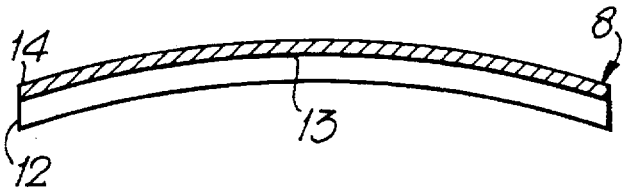
FIG. 5 is a sectional view of the structure of FIG. 4 after graphite has been machined away to form the accelerator grid of the thruster shown in FIG. 1.

The block 12 is then cut away along the dotted line shown to produce the reduced cylindrical block of FIG. 4. The bottom surface of this block is then machined to the same curvature as the top surface and the thickness of the graphite reduced (FIG. 5.) The molybdenum layer 14 provides a structural support for the now thin layer of graphite during the machining process.

The second molybdenum grid 15 is then bonded to the graphite face and spacers of the same material 16 welded in place.

In the final stage, apertures are drilled through the graphite using the existing apertures of the molybdenum grids 14 and 15 as guides. The molybdenum grids 14 and 15 are manufactured as one grid which is cut in half through its thickness. This permits alignment of the apertures in the layers 14 and 15 for this final drilling stage. The resultant product is a sandwich as shown in section in FIG. 6. (The thickness of the layers has been exaggerated for clarity.) Because the grid comprises a layer which includes graphite, the erosion properties are significantly superior to a grid which is made solely of molybdenum, but the presence of the molybdenum layers 14 and 15 enables the graphite to be machined to a contour and with a density of apertures which would not be possible without its support properties. These support properties are also important during the mechanical vibration which the grid will have to encounter on launch of a satellite incorporating such ion thrusters.

This method of construction enables flat or curved accelerator grids to be manufactured. Such curved grids produce well-focused ionic beams, the divergence of such a beam being typically around 10° .

Figure 7:
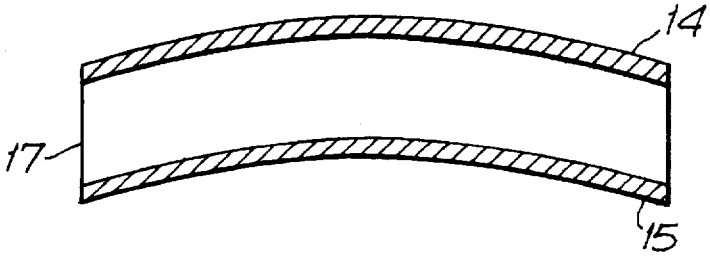
FIG. 7 is a sectional view of another accelerator grid for the ion thruster of FIG. 1.

Another version of the accelerator grid is shown in FIG. 7 and comprises two molybdenum grids 14 and 15 with a layer of adhesive loaded with a substantial percentage of graphite 17 sandwiched between. This is an alternative way to retain the low sputter yield of graphite without the necessity for machining it.

Figure 6:
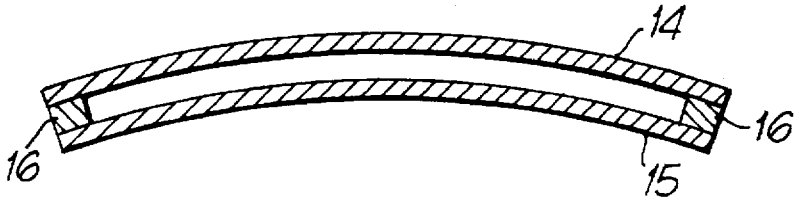
FIG. 6 is a sectional view of an alternative accelerator grid for the ion thruster of FIG. 1.

Typical dimensions for the grids of FIGS. 6 and 7 are as follows. The diameter of the grid in FIG. 6 may be from around 10 cm to 50 cm. The thickness to which the graphite is machined may be around half a millimeter, and the thickness of the molybdenum layers may be around one quarter of a millimeter. Suitable adhesives for securing the molybdenum grid to the graphite are RTV (room temperature-vulcanizing) types.

In the case of the FIG. 7 embodiment, the layers 14 and 15 may be around one quarter of a millimeter in thickness, and the layer 17 may be around 0.5 mm in thickness. Suitable adhesive for the layer 17 is RTV.

Variations may be made without departing from the scope of the invention, for instance materials other than molybdenum may be used to provide a support layer for the layer which includes graphite. The lower molybdenum layer 15 may be omitted to produce, after drilling, a two-layer grid as shown in FIG. 5. The invention can also be used where ions are produced by an r.f. field, rather than by using an anode and a cathode. The electrons are given energy to bombard and ionise the propellant by means of an electrodeless annular r.f. discharge.

I claim:

1. An ion thruster comprising a chamber in which propellant is ionized, and an accelerator grid whereby a reactive thrust is provided by a flow of ions out of the chamber, wherein the grid comprises a grid layer which includes graphite and a support layer for supporting the grid layer which includes graphite.

2. An ion thruster as claimed in claim 1 in which the support layer is made of molybdenum.

3. An ion thruster as claimed in claim 1 in which the grid is made by securing the support layer to solid graphite having the profile desired for the accelerator grid, and excess graphite is thereafter machined away.

4. An ion thruster as claimed in claim 1 in which the grid layer and the support layer have apertures, and in which the apertures in the grid layer are formed using the apertures in the support layer as guides.

5. An ion thruster as claimed in claim 1 including a second support layer so that the grid layer is sandwiched between the support layers.

6. An ion thruster as claimed in claim 1 in which the grid layer which includes graphite consists of a material loaded with graphite.

7. An ion thruster as claimed in claim 6 in which the material loaded with graphite is polymeric.

8. An ion thruster as claimed in claim 1 in which the accelerator grid has a curved surface.

9. An ion thruster as claimed in claim 1 in which in use the chamber is at a positive potential and the accelerator grid is at a negative potential.

10. A spacecraft including an ion thruster as claimed in claim 1.

* * * * *